US005580480A

United States Patent [19]

Chatelain

[11] Patent Number: 5,580,480

[45] Date of Patent: Dec. 3, 1996

[54] FORM FOR MAKING FENCE POSTS IN SITU

[76] Inventor: Paul J. Chatelain, P.O. Box 6404, Whittier, Calif. 90609

[21] Appl. No.: 521,282

[22] Filed: Aug. 30, 1995

Related U.S. Application Data

[63] Continuation of Ser. No. 176,435, Jan. 3, 1994, abandoned.

[51] Int. Cl.[6] ..... E04G 13/02

[52] U.S. Cl. ..... 249/51; 52/148; 249/143; 249/170; 249/207; 249/213; 264/31

[58] Field of Search ..... 249/51, 143, 207, 249/213, 170; 264/31; 52/127.2, 148, 149, 150, 151

[56] References Cited

U.S. PATENT DOCUMENTS

| | | | |
|---|---|---|---|
| 323,793 | 8/1885 | Copeland | 52/148 |
| 606,530 | 6/1898 | Flesher et al. | 52/148 |
| 698,424 | 4/1902 | Warner | 52/148 |
| 714,683 | 12/1902 | Ewell | 249/51 |
| 720,025 | 2/1903 | Harbold | 52/148 |
| 856,138 | 6/1907 | Grassfield | 52/148 |
| 883,569 | 3/1908 | Rodgers | 249/143 |
| 975,135 | 11/1910 | Kelsey et al. | 249/143 |
| 986,957 | 3/1911 | Wallin | 249/143 |
| 1,134,854 | 4/1915 | Hoy | 249/51 |
| 1,147,075 | 7/1915 | Burris | 249/143 |
| 1,165,029 | 12/1915 | Small | 52/148 |
| 1,298,341 | 3/1919 | Henkle | 249/143 |
| 1,316,895 | 9/1919 | Houff | 52/148 |
| 1,651,776 | 12/1927 | Meeg-Larssen et al. | 249/51 |
| 2,923,382 | 2/1960 | Heldstab | 52/148 |
| 3,024,512 | 3/1962 | Dyer | 249/143 |
| 4,790,509 | 12/1988 | Cardwell et al. | 249/51 |

OTHER PUBLICATIONS

Waddell, Joseph J., Concrete Construction Handbook, 2nd Ed., McGraw-Hill Book Co., NY, ©1974, pp. 3–1 to 3–3, 14–28 to 14–29, and 25–18 to 25–19.

*Primary Examiner*—Jay H. Woo
*Assistant Examiner*—Joseph Leyson
*Attorney, Agent, or Firm*—Edgar W. Averill, Jr.

[57] ABSTRACT

A form for making a concrete fence post supported by the ground is disclosed. The form has two elongated halves which are hinged together and clamped along one edge. The form is supported over a post hole and concrete is poured into the form. Reinforcing bars or mesh is inserted in the wet concrete and the concrete is permitted to set. The form is then opened and removed resulting in a reinforced concrete fence post. The process of using the form is also disclosed.

1 Claim, 4 Drawing Sheets

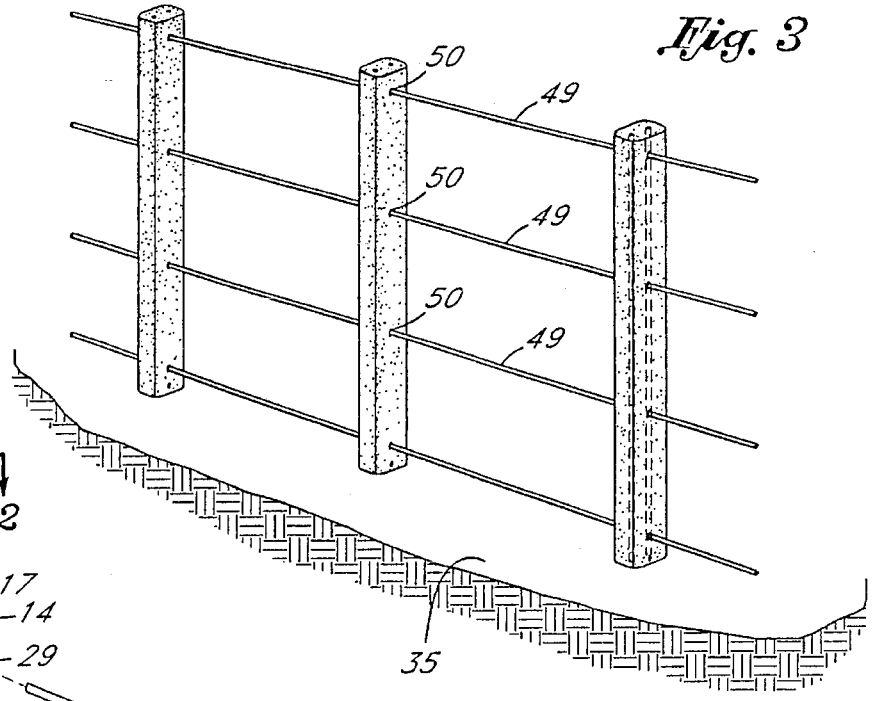
Fig. 3
Fig. 1
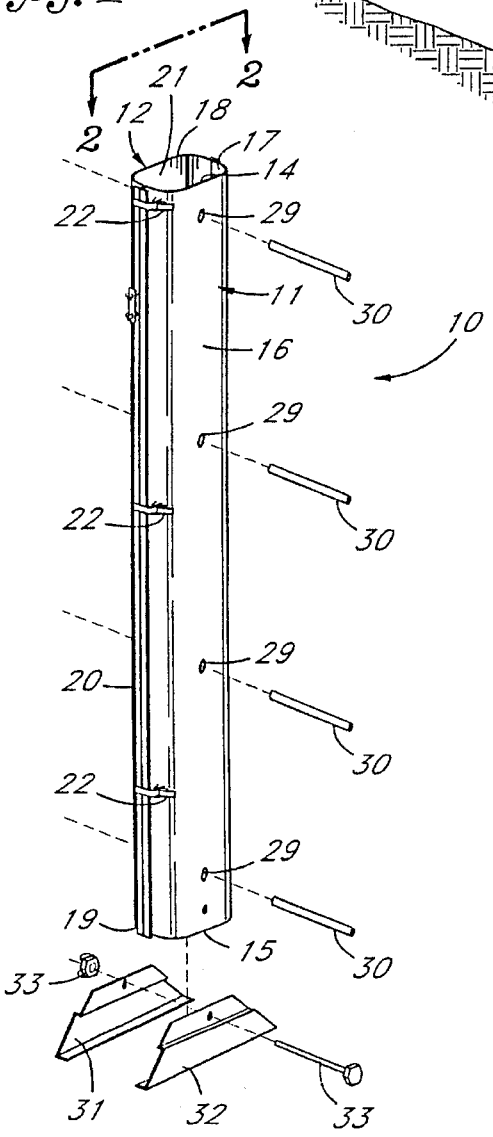
Fig. 2
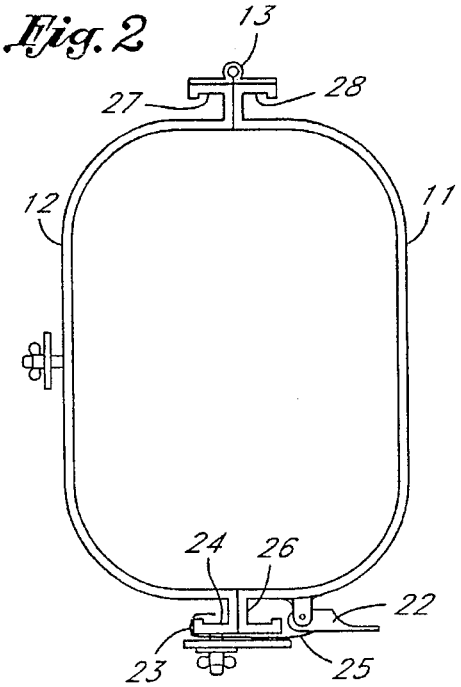

FORM FOR MAKING FENCE POSTS IN SITU

This application is a continuation of application Ser. No. 08/176,435 filed on Jan. 3, 1994 now abandoned.

BACKGROUND OF THE INVENTION

The field of the invention is fence posts and the invention relates more particularly to concrete fence posts.

A large amount of lumber each year is used to make fence posts. Such posts are supported in the ground either by the wood contacting the ground or preferably by pouring concrete around a post which is placed in a post hole. Unfortunately, such posts are subject to attack by termites and also subject to rot and even treated posts have a life of only about 10 to 15 years in anything but the most arid of climates. The posts then have to be replaced which also consumes a substantial amount of additional wood and which is once again subject to destruction by termites, rot and other forces.

Concrete has been used since the Roman Empire. Concrete pillars are used in construction of buildings, bridges and the like. Concrete fence posts are known but are typically prefabricated such as that shown in U.S. Pat. No. 4,193,584. Such fence posts, although free from destruction by termites and rotting, are expensive and very heavy. This weight makes them very difficult to use without specialized lifting apparatus. Another patent showing a prefabricated cement post is U.S. Pat. No. 3,614,068. A reinforced fence pole made from concrete is shown in U.S. Pat. No. 4,637,186 where the pole is fabricated in a mold, cured and then removed and inserted into the ground. A cast-in-place prestressed concrete piling is shown in U.S. Pat. No. 4,915,544 which has a moveable casing and forms a concrete pile in the ground. The Wells U.S. Pat. No. 4,767,241 discloses a method for forming footings and piers in concrete construction. This patent shows a one-time used plastic footing mold upon which a cardboard tube of the type sold under the trademark "SONOTUBE" is placed and this permits the footing to be formed at the same time the pier is formed.

None of these processes suggest a reusable form for concrete fence posts.

SUMMARY OF THE INVENTION

It is an object of the present invention to provide a reusable form for casting concrete fence posts which are poured on site and are supported over the hole.

The present invention is for a process for forming a concrete fence post in situ. The post is formed by digging a two foot dirt hole in the ground. A form is supported over the hole. Concrete is poured into the hole and the form and allowed to cure. The form is then removed.

The present invention is also for a form having first and second elongated form halves which are hinged together and which may be removably clamped in a closed position. The form is supported vertically over a post hole and preferably several reinforcing bars are placed in the form after it has been partially filled with concrete. The form is then filled with concrete, tapped with a rubber mallet to expel air and allowed to set. After about four hours the form may be removed and reused. Preferably several rods are placed through holes in the mold to form cylindrical openings in the cured post.

BRIEF DESCRIPTION OF THE DRAWINGS

FIG. 1 is a perspective view of the first embodiment of the form of the present invention in a closed configuration.

FIG. 2 is an enlarged view taken along line 2—2 of FIG. 1.

FIG. 3 is a perspective view of a plurality of concrete fence posts supported in the ground.

DESCRIPTION OF THE PREFERRED EMBODIMENTS

Figure 4:
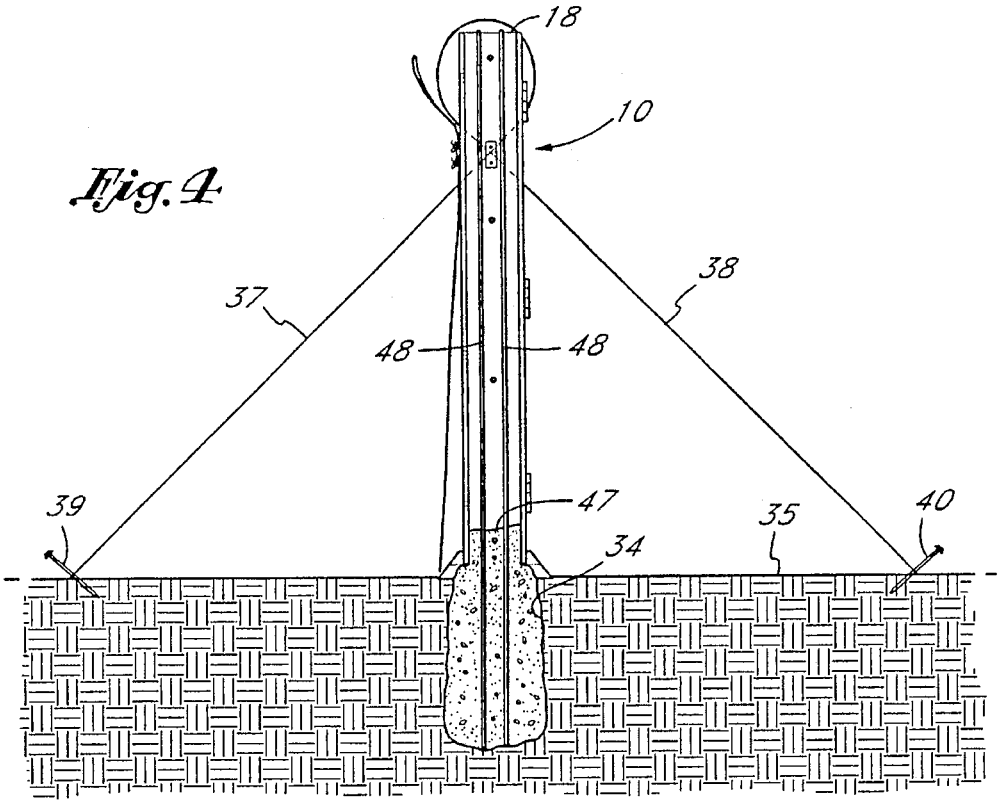
FIG. 4 is a cross-sectional side view of the form of the present invention supported over a post hole in the ground partially filled with concrete.

The first embodiment of the form of the present invention is shown in perspective view in FIG. 1 and indicated generally by reference character 10. Form 10 has a first form half 11 and a second form half 12 which are hinged together as shown best in FIG. 2 by hinges 13. First form half 11 has a top 14, a bottom 15, an exterior surface 16 and an interior surface 17. Similarly second form half 12 has a top 18, a bottom 19, an exterior surface 20 and an interior surface 21. Three over-center clamps 22 are held by first form half 11 and have a clasp that overhangs the edge 23 of channel 24 of second form half 12. The clasp 25 of over-center clamp 22 extends over channel 26 of first form half 11. Hinge 13 is welded or otherwise affixed to channels 27 and 28 of second and first form halves respectively. This permits the form to be opened after the concrete has set by opening over-center clamps 22 and hingedly opening the first and second form halves and pulling them away from the cast concrete post. Preferably each form half has a plurality of holes 29 and second form half 12 has a matching set of holes 29. Rods 30 are placed through holes 29 and the matching holes 29 in second form half 12. These rods 30 thus form openings through the cast concrete post. The rods of course are inserted through the holes prior to the pouring of the concrete into the form and are removed after the concrete has set.

A pair of foot members 31 and 32 are pivotly held by fastening means 33 such as wing nuts and bolts to form halves 11 and 12 near the bottom thereof.

Figure 5:
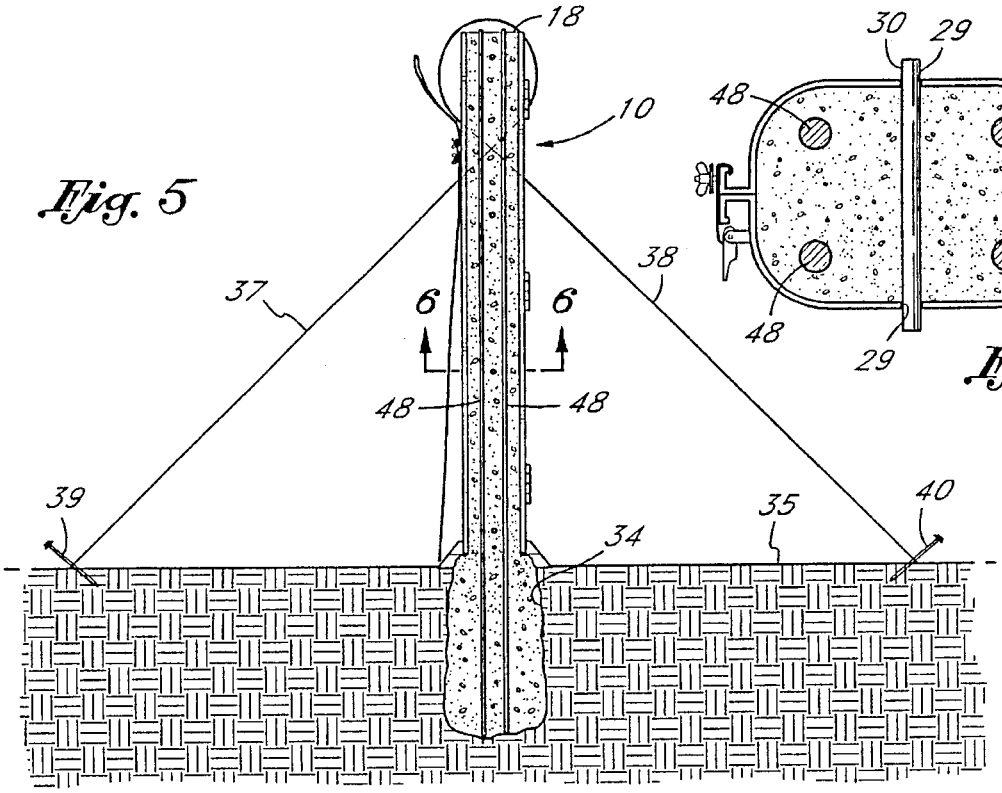
FIG. 5 is a cross-sectional view of the form of FIG. 4 completely filled with concrete and supported by a pair of lines staked into the ground.
Figures 7, 8:
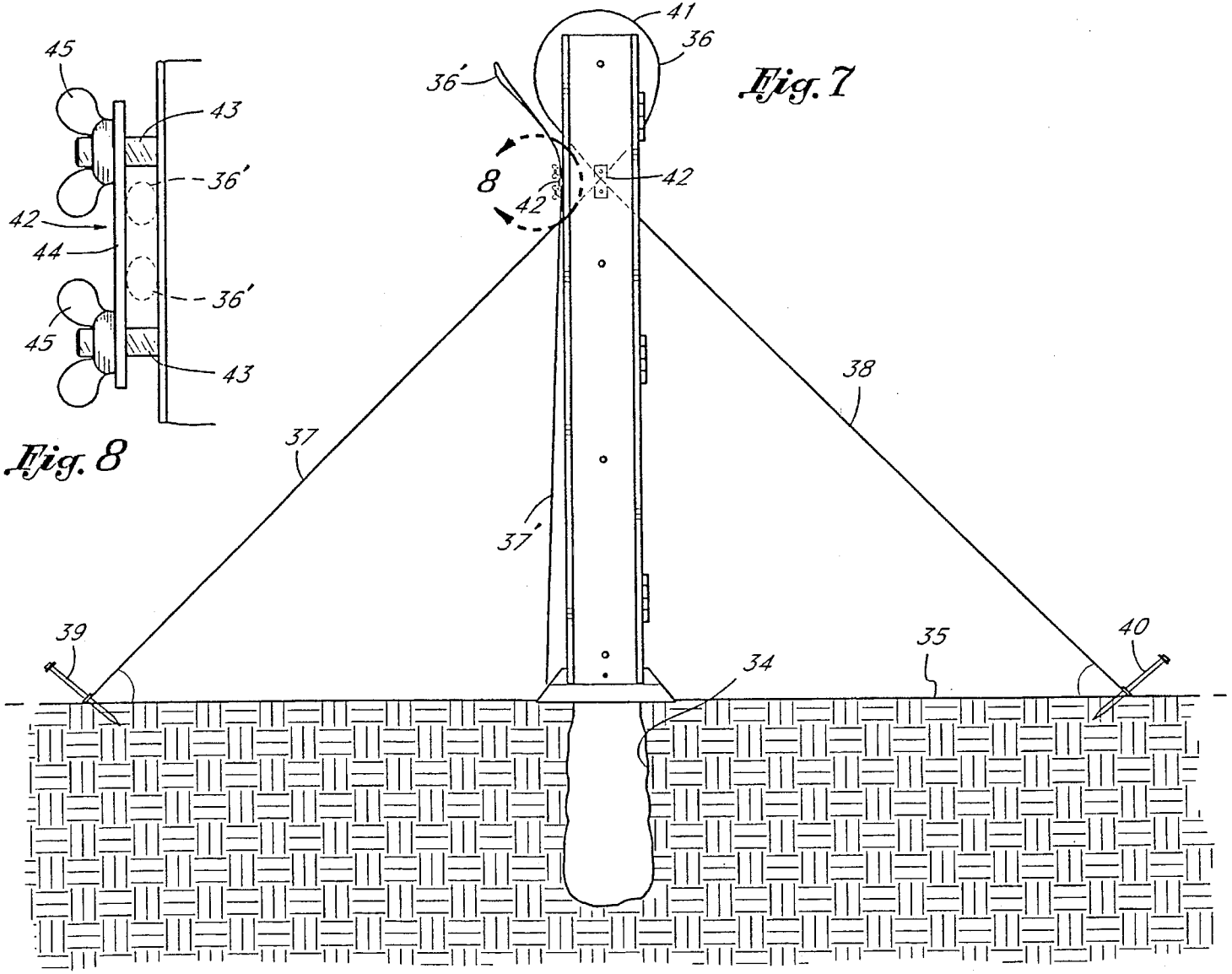
FIG. 7 is a side view showing the form of FIG. 1 supported by the ground shown in cross-section.
FIG. 8 is an enlarged view taken along line 8—8 of FIG. 7 showing the rope clamp of the mold of FIG. 1.
Figure 9:
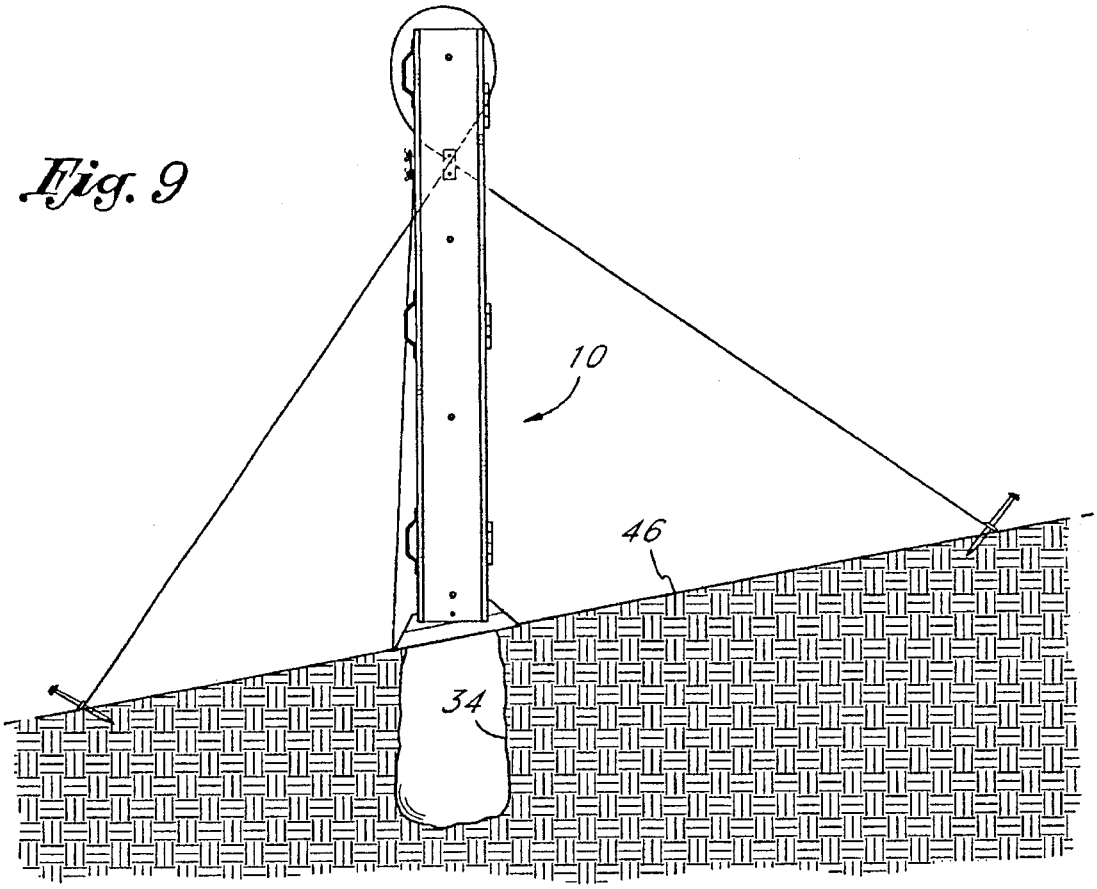
FIG. 9 is a side view showing the form of the present invention supported on a ground surface which is not horizontal.

The process of forming a concrete fence post may be seen by viewing FIGS. 4 and 5. A hole 34 is dug in the ground 35. Hole 34 need not be as large as a hole made to support a conventional wooden fence post in concrete. It need only be about 6 inches in diameter and the foot members 31 and 32 straddle the hole and are supported by the ground 35. It is important that means be provided to support form 10 in a vertical position. One particularly effective manner of doing this is shown best in FIG. 7 of the drawings. A line 36 has a first leg 37 and a second leg 38 which are held to the ground by pegs 39 and 40 respectively on opposite sides of the form as shown in FIGS. 4, 5 and 7. Line 36 includes a loop 41 which is formed as line 36 passes through clamp 42 shown in FIG. 8. Clamp 42 has a pair of studs 43 over which a plate 44 has been placed. Plate 44 of course has a pair of matching holes which pass over studs 43. A pair of wing nuts 45 facilitate the tightening of plate 44 against the line 36. Line 36' is identical to line 36 except that it is held at a 900 angle with respect to line 36. Once the stakes 39 and 40 have been driven into the ground, a level is placed against either the right or left side of form 10 as shown in FIG. 7 and the form is moved either to the left or the fight until it is exactly vertical and both legs 37 and 38 are tight after which the wing nuts 45 are tightened against the line. Next the level is placed on an adjacent surface of the form and the same process is carried out with line 36'. The result is a form which is vertical. This may be done even though the ground is not level as indicated by the sloped ground 46 in FIG. 9. While this method is preferred because of its low cost and simplicity, other leveling means may be used such as telescoping rods affixed to two adjacent sides.

Figure 6:
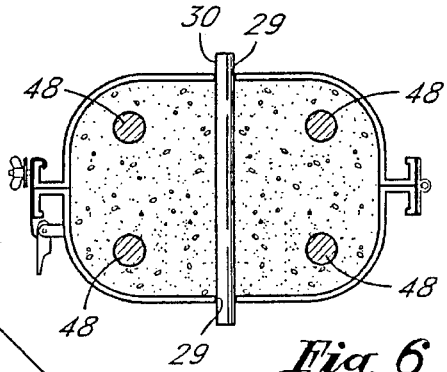
FIG. 6 is a cross-sectional view taken along line 6—6 of FIG. 5.

Returning now to FIG. 4, concrete is poured into the top of form 10 to a level 47 slightly above the ground 35. Preferably four reinforcing bars or wire mesh 48 are then inserted into the concrete which has been poured to level 47. This permits the reinforcing bars to be placed near the corners as shown in FIG. 6 of the drawings and also they need not go to the bottom of hole 34 so that the reinforcing bars are preferably surrounded by concrete and not in contact with the ground. Also as shown in FIG. 6 one of the rods 30 has been passed through holes 29 which may be later removed to form holes in the cured concrete post.

Next the concrete post is allowed to set, typically for about four hours. The setting can of course be speeded up by a means well known in the concrete trade in which case of course the form may be removed sooner. The exterior surface of the concrete post is smooth and the post is of course completely immune from termites or rot. Preferably the form is fabricated from steel, although plastic forms are also contemplated. When steel forms are used the inner surface should be covered with a release agent such as vegetable oil.

Figure 10:
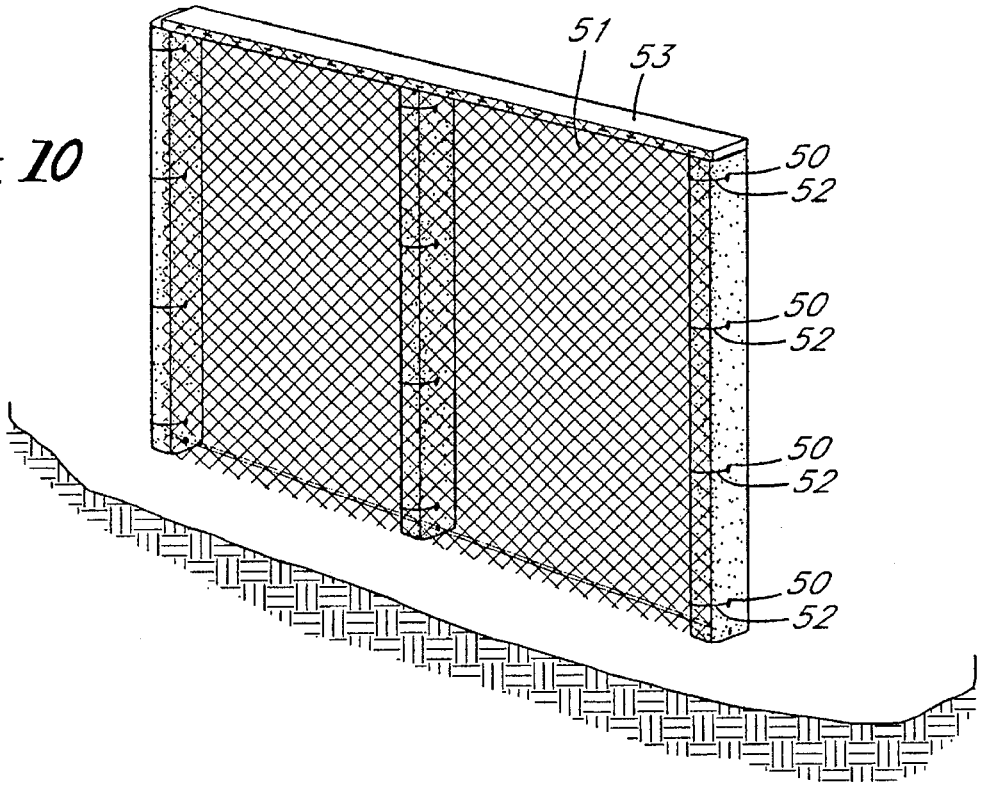
FIG. 10 is a perspective view of three concrete fence posts formed by the mold of FIG. 1 having a chain link fence held thereon.

The finished posts are shown in FIG. 3 and a fence may be completed by passing a cable through each of the holes formed in the post by rods 30. The upper cable 49 may be electrified if the posts are used for enclosing livestock. The holes which are indicated by reference character 50 may also be used in other ways to hold a fence thereto. For instance, in FIG. 10 a chain link fence 51 has been held by hog ties 52. Also it is contemplated that studs may be inserted in the top of the concrete prior to its setting and these can be used to bolt a top board 53 to the top of the concrete posts. Bolts can also be passed through holes 50 to hold a fence support board to which other fencing material may be nailed. Such board would be above ground and thus much less subject to termites and rotting. It could of course be easily replaced if it did eventually deteriorate.

The resulting post of the present invention is very strong and almost indestructible by the normal forces of nature.

It is also contemplated that a plastic sleeve could be inserted into form 10 prior to the pouring of the concrete so that the resulting concrete post would have an attractive vinyl exterior.

While a conventional hinge is shown in the drawings, it is contemplated that other methods of hingedly supporting the two halves may be used. For instance, if the form 10 is fabricated from plastic the plastic could be flexible enough to permit the form to be opened sufficiently so that it can be lifted off of the cured concrete post.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An apparatus for making concrete fence posts supported by the ground said apparatus comprising a form, said form comprising:

a first elongated form half having a bottom, a top, an interior surface and an exterior surface, an open side edge, and a hinged side edge;

a second form half hingedly affixed to said hinged side edge of said first form half by hinge means, said second form half having a bottom, a top, an interior surface and an exterior surface, an open side edge, and a hinged side edge; and clamp means affixed between said first and second elongated form halves along the open side edges thereof and said apparatus further comprising:

means for supporting said form in a vertical position comprising:

a first support line having a first end and a second end, each of said ends having a stake which is pounded into the ground, said first support line including a loop held by a line clamp affixed to one of said first and second form halves; and a second support line having a first end and a second end, each of said ends having a stake which is pounded into the ground, said second support line including a loop held by a line clamp affixed to one of said first and second form halves, whereby said stakes on the first support line are pounded into the ground on opposite sides of the form, said stakes on the second support line are pounded into the ground on opposite sides of the form, the first support line is held at 90° with respect to the second support line, and the lines are tightened against the form by said line clamps.

* * * * *